US009691317B2

(12) United States Patent
Li

(10) Patent No.: US 9,691,317 B2
(45) Date of Patent: Jun. 27, 2017

(54) IMAGE DISPLAY CONTROL METHOD AND IMAGE DISPLAY CONTROL DEVICE

(71) Applicants: BOE TECHNOLOGY GROUP CO., LTD., Beijing (CN); BEIJING BOE CHATANI ELECTRONICS CO., LTD., Beijing (CN)

(72) Inventor: Dejun Li, Beijing (CN)

(73) Assignees: BOE TECHNOLOGY GROUP CO., LTD., Beijing (CN); BEIJING BOE CHATANI ELECTRONICS CO., LTD., Beijing (CN)

( * ) Notice: Subject to any disclaimer, the term of this patent is extended or adjusted under 35 U.S.C. 154(b) by 113 days.

(21) Appl. No.: 14/429,161

(22) PCT Filed: May 22, 2014

(86) PCT No.: PCT/CN2014/078120

§ 371 (c)(1),
(2) Date: Mar. 18, 2015

(87) PCT Pub. No.: WO2015/067030

PCT Pub. Date: May 14, 2015

(65) Prior Publication Data

US 2016/0027360 A1 Jan. 28, 2016

(30) Foreign Application Priority Data

Nov. 8, 2013 (CN) ..... 2013 1 0553613

(51) Int. Cl.

| | |
|---|---|
| ***G09G 3/20*** | (2006.01) |
| ***G09G 3/34*** | (2006.01) |
| ***G09G 5/02*** | (2006.01) |

(52) U.S. Cl.

CPC ..... *G09G 3/2003* (2013.01); *G09G 3/3413* (2013.01); *G09G 5/026* (2013.01);

(Continued)

(58) Field of Classification Search

CPC ..... G09G 3/2003; G09G 2320/0666

See application file for complete search history.

(56) References Cited

U.S. PATENT DOCUMENTS

2003/0222894 A1* 12/2003 Toji ..... G09G 5/02 345/694

2007/0085863 A1* 4/2007 Moriya ..... G09G 3/3607 345/694

(Continued)

FOREIGN PATENT DOCUMENTS

CN 101211539 A 7/2008

CN 102074206 A 5/2011

(Continued)

OTHER PUBLICATIONS

International Application No. PCT/CN2014/078120, International Search Report dated Aug. 29, 2014, thirteen (13) pages.

(Continued)

*Primary Examiner* — Carolyn R Edwards

*Assistant Examiner* — Mansour M Said

(74) *Attorney, Agent, or Firm* — Nath, Goldberg & Meyer; Joshua B. Goldberg; Christopher Thomas

(57) ABSTRACT

The present invention discloses an image display control method and an image display control device for realizing an ideal display result of chroma by compensating the chroma values of all sub-pixels used for displaying the current frame of an image. The image display control method comprises: acquiring chroma values, output by a signal source, of all sub-pixels needed when a display device displays the current frame of an image; adjusting the acquired chroma values of all the sub-pixels according to pre-stored chroma compensation values corresponding to respective sub-pixels to obtain adjusted chroma values corresponding to respective sub-pixels; and driving the display device according to the (Continued)

adjusted chroma values corresponding to respective sub-pixels to display the current frame of the image.

8 Claims, 3 Drawing Sheets

(52) U.S. Cl.
CPC ..... *G09G 2320/0242* (2013.01); *G09G 2320/0285* (2013.01); *G09G 2320/0666* (2013.01)

(56) References Cited

U.S. PATENT DOCUMENTS

| | | | | |
|---|---|---|---|---|
| 2011/0084988 | A1* | 4/2011 | Shih | G09G 3/3607 345/690 |
| 2013/0050504 | A1 | 2/2013 | Safaee-Rad et al. | |
| 2013/0215360 | A1* | 8/2013 | Pollack | G09G 3/3413 349/61 |
| 2014/0267470 | A1* | 9/2014 | Kang | G09G 3/2003 345/694 |

FOREIGN PATENT DOCUMENTS

| | | | |
|---|---|---|---|
| CN | 102687193 | A | 9/2012 |
| CN | 102883168 | A | 1/2013 |
| CN | 103229228 | A | 7/2013 |
| CN | 103559866 | A | 2/2014 |
| JP | 2009152678 | A | 7/2009 |
| JP | 2012015894 | A | 1/2012 |

OTHER PUBLICATIONS

Chinese Patent Application No. 2013105536133, Office Action dated Feb. 28, 2015, six (6) pages. English translation attached.

* cited by examiner

IMAGE DISPLAY CONTROL METHOD AND IMAGE DISPLAY CONTROL DEVICE

This is a National Phase Application filed under 35 U.S.C. 371 as a national stage of PCT/CN2014/078120, filed May 22, 2014, and claims priority benefit from Chinese Application No. 201310553613.3, filed Nov. 8, 2013, the content of each of which is hereby incorporated by reference in its entirety.

FIELD OF THE INVENTION

The present invention relates to the field of image display technology, and particularly relates to an image display control method and an image display control device.

BACKGROUND OF THE INVENTION

Three primary colors of light refer to red, green and blue, and may be mixed according to a certain ratio to present light of various colors. The screen of a color television is composed of light emitting spots of red, green and blue. The three primary colors may be mixed according to different ratios and intensities to form various colors in nature, and a color is expressed by brightness and chroma together.

The chroma of an image displayed by a display device is determined by the chroma value in an image data signal output by a signal source. However, for a display device which needs to use a backlight module (including a light source), the performance of the light source may inevitably influence the chroma of the image displayed by the display device.

An existing method for displaying an image by a display device includes steps of:

step 1: acquiring, by an image signal processor, chroma values, output by a signal source, of all sub-pixels needed when the display device displays the current frame of an image; and step 2: driving, by the image signal processor, the display device to display the current frame of the image according to the chroma values of all the sub-pixels.

The applicant has discovered that, the existing method for displaying an image by a display device has the following shortcomings:

1. Hardware is adopted in the prior art to adapt to an image data signal, namely hardware is selected according to the chroma range of the image to be displayed. However, processing errors inevitably exist in industrial processing of the hardware, so the hardware can only ensure the consistency of the theoretical chroma and the practical chroma within a certain range but cannot ensure the complete consistency of the theoretical chroma and the practical chroma.

2. To ensure the color display effect of the display device, the limitation to the chroma range of the display device is narrow, so that the requirement for control precision in the industry of display devices and accessories thereof is high. The range of available materials for manufacturing the display device is small, so that the cost of the display device is high. For example, due to narrow chroma range of light source required in the prior art, the yield of the light source (e.g. an LED light source) is low, and then the cost of the display device is correspondingly high.

3. To meet the requirement for the chroma of the LED light source while improve the yield of the LED light source, LED Light Bars are mostly produced and used in an LED lamp mixed BIN manner, so that the problems of non-uniform chroma in picture and the like appear.

4. With the increase of service time of the display device, the performance of the light source or individual components attenuates or varies, so that the chroma of the image displayed by the display device is changed, and then the user experience is influenced.

5. Because color filters, manufacturing processes and the like used for producing liquid crystal panels in various manufacturers are different and the requirements for the chroma of the light source are inconsistent, components such as the light source and the like may not be universal in the industry.

To sum up, the existing method for displaying an image by a display device has the shortcoming that the practical chroma is inconsistent with the chroma (namely theoretical chroma) acquired from the image data signal output by the signal source or the chroma difference is beyond an error range, so that the display effect of the display device is seriously influenced.

SUMMARY OF THE INVENTION

The present invention provides an image display control method and an image display control device, for realizing an ideal display result of chroma by compensating the chroma values of all sub-pixels used for displaying the current frame of an image.

An image display control method provided by the present invention includes the following steps:

acquiring chroma values, output by a signal source, of all sub-pixels needed when a display device displays a current frame of an image;

adjusting the acquired chroma values of all the sub-pixels according to pre-stored chroma compensation values corresponding to respective sub-pixels to obtain adjusted chroma values corresponding to respective sub-pixels; and driving the display device to display the current frame of the image according to the adjusted chroma values corresponding to respective sub-pixels.

Preferably, before driving the display device to display the current frame of the image, the method further includes a step of acquiring the chroma compensation values corresponding to respective sub-pixels, and this step may further include:

acquiring first chroma values respectively corresponding to respective sub-pixels needed when the display device displays a current frame of a test image, and driving the display device according to the first chroma values respectively corresponding to respective sub-pixels to display the current frame of the test image;

measuring, at a light exiting side of the display device, second chroma values respectively corresponding to respective sub-pixels when the current frame of the test image is displayed; and acquiring differences between the first chroma values and the second chroma values respectively corresponding to respective sub-pixels, as the chroma compensation values corresponding to respective sub-pixels.

Preferably, the first chroma values respectively corresponding to respective sub-pixels needed when the current frame of the test image is displayed are equal to each other.

Preferably, the measuring, at the light exiting side of the display device, second chroma values respectively corresponding to respective sub-pixels when the current frame of the test image is displayed is specifically as follows:

respectively measuring the chroma values of light at a plurality of test angles at an optimal viewing distance from the light exiting side of the display device, and taking average values of a plurality of measured chroma values for respective sub-pixels as the second chroma values respectively corresponding to respective sub-pixels.

Preferably, after acquiring the chroma compensation values corresponding to respective sub-pixels and before driving the display device to display the current frame of the image, the method further includes a step of:

storing the chroma compensation values corresponding to respective sub-pixels.

Preferably, the step of adjusting the acquired chroma values of all the sub-pixels according to pre-stored chroma compensation values corresponding to respective sub-pixels to obtain adjusted chroma values corresponding to respective sub-pixels further includes:

respectively summating the acquired chroma values of respective sub-pixels and the pre-stored chroma compensation values corresponding to respective sub-pixels, and taking the summated values as the adjusted chroma values corresponding to respective sub-pixels.

The present invention further provides an image display control device, including:

a chroma value acquisition unit, configured to acquire chroma values, output by a signal source, of all sub-pixels needed when a display device displays a current frame of an image;

a chroma value adjustment unit, configured to respectively adjust the acquired chroma values of all the sub-pixels according to pre-stored chroma compensation values corresponding to respective sub-pixels to obtain adjusted chroma values corresponding to respective sub-pixels; and an image display control unit, configured to drive the display device according to the adjusted chroma values corresponding to respective sub-pixels to display the current frame of the image.

Preferably, the chroma value adjustment unit is further configured to respectively summate the acquired chroma values of respective sub-pixels and the pre-stored chroma compensation values corresponding to respective sub-pixels to obtain the adjusted chroma values corresponding to respective sub-pixels.

Preferably, the image display control device further includes a storage unit configured to store the chroma compensation values corresponding to respective sub-pixels.

To sum up, the present invention provides an image display control method and an image display control device, wherein an image data signal may adapt to the performance of hardware adopted in the display device by adjusting the chroma values of each frame of image data before each frame of the image is displayed, so that the image display precision of the display device is improved, the display quality of the display device is improved, and the cost of the display device is reduced.

DETAILED DESCRIPTION OF THE EMBODIMENTS

The present invention provides an image display control method and an image display control device, which realize an ideal display result of chroma by compensating the chroma values of all sub-pixels in an image signal for driving a display device to display the current frame of an image.

The color of an image is determined by brightness and chroma together. Generally, a pixel on an image displayed by a display device is composed of red, green and blue sub-pixels. A light source behind each sub-pixel may display the chroma with a certain value, and the pixels on a display panel may display the chroma with different values by controlling respective sub-pixels.

Generally, a light source in a backlight module and a color filter on a color filter substrate may influence the chroma of an image displayed by a display device, so that the chroma values (namely practical chroma values) of the image practically displayed by the display device are different from the chroma values (namely theoretical chroma values) acquired from an image data signal output by a signal source, and thereby the display effect of the image displayed by the display device in practical is inconsistent with the expected display effect of the image.

According to the embodiments of the present invention, adjusted chroma values are obtained by adjusting the chroma values for all sub-pixels in an image data signal for driving a display device to display an image, and then the display device is driven according to the adjusted chroma values to realize image display, so that the chroma values (namely practical chroma values) of an image viewed by human eyes is consistent with the chroma values (namely theoretical chroma values) acquired from an image data signal output by a signal source. Compared with a case where an image data signal is adapted by selection of appropriate hardware in the prior art, the present invention has the advantages that the image data signal adapts to the performance of hardware adopted in the display device, so that the display precision of an image is improved, the display quality of the display device is improved, and the cost of the display device is reduced.

The technical solutions provided by the embodiments of the present invention will be specifically described below in connection with accompanying drawings.

Figure 1:
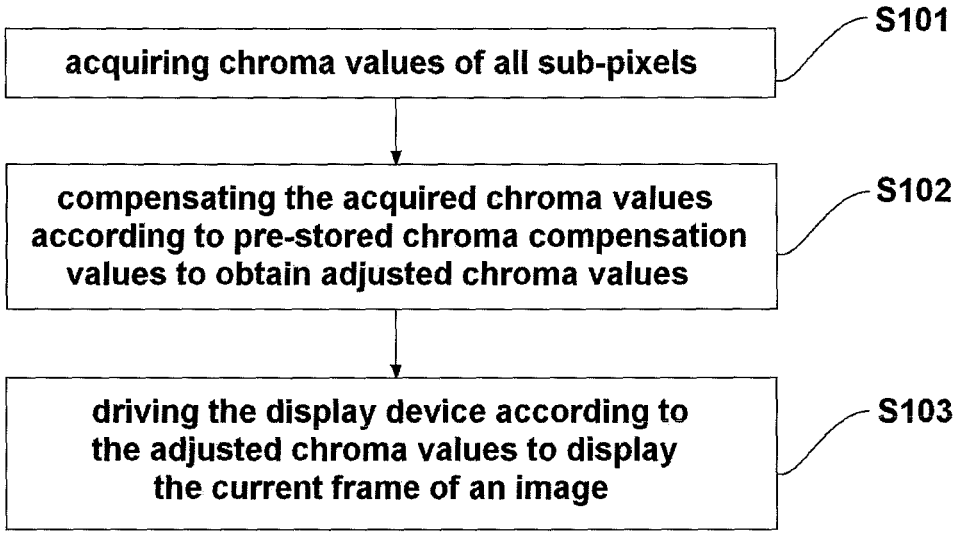
FIG. 1 is a schematic diagram of an overall flow of an image display control method provided by an embodiment of the present invention.

Referring to FIG. 1, an image display control method provided by an embodiment of the present invention may include the following steps of S101 to S103.

S101, acquiring chroma values, output by a signal source, of all sub-pixels needed when a display device displays a current frame of an image.

Specifically, the signal source may output an image data signal at least including the chroma values of all the sub-pixels to an image signal processor. The image signal processor extracts the chroma values of all the sub-pixels from the received image data signal.

S102, adjusting the acquired chroma values of the sub-pixels respectively according to pre-stored chroma compensation values corresponding to respective sub-pixels, so as to obtain adjusted chroma values corresponding to respective sub-pixels.

S103, driving the display device according to the adjusted chroma values corresponding to respective sub-pixels to display the current frame of the image.

Preferably, before the display device is driven to display the current frame of the image, the method further includes a step of acquiring the chroma compensation values corresponding to respective sub-pixels, and this step may specifically include the follow steps of acquiring first chroma values of all the sub-pixels needed when the display device displays a current frame of a test image, and driving the display device according to the first chroma values of all the sub-pixels to display the current frame of the test image;

measuring, at the light exiting side of the display device, second chroma values of all the sub-pixels when the current frame of the test image is displayed; and obtaining differences between the first chroma values and the second chroma values of all the sub-pixels, wherein the differences are the chroma compensation values corresponding to respective sub-pixels.

In a specific example, the image signal processor may acquire ideal chroma values (namely the first chroma values) of all the sub-pixels from a test image data signal for driving the display device to display the current frame of the test image. In addition, a chroma measurement device such as a chroma measurer may be adopted to measure respective practical chroma values (namely the second chroma values) of all the sub-pixels.

Preferably, after the chroma compensation values corresponding to respective sub-pixels are acquired and before the display device is driven to display the current frame of the image, the method further includes a step of storing the chroma compensation values corresponding to respective sub-pixels. For example, the chroma compensation values may be manually or automatically stored in a storage unit in the image signal processor or stored in a memory outside the image signal processor.

Preferably, the step of adjusting, by the image signal processor, the acquired chroma values of the sub-pixels respectively according to the pre-stored chroma compensation values corresponding to respective sub-pixels, so as to obtain the adjusted chroma values corresponding to respective sub-pixels may further include:

the image signal processor respectively summates the acquired chroma values of respective sub-pixels and the pre-stored chroma compensation values corresponding to respective sub-pixels, so as to obtain the adjusted chroma values corresponding to the sub-pixels.

Figure 2:
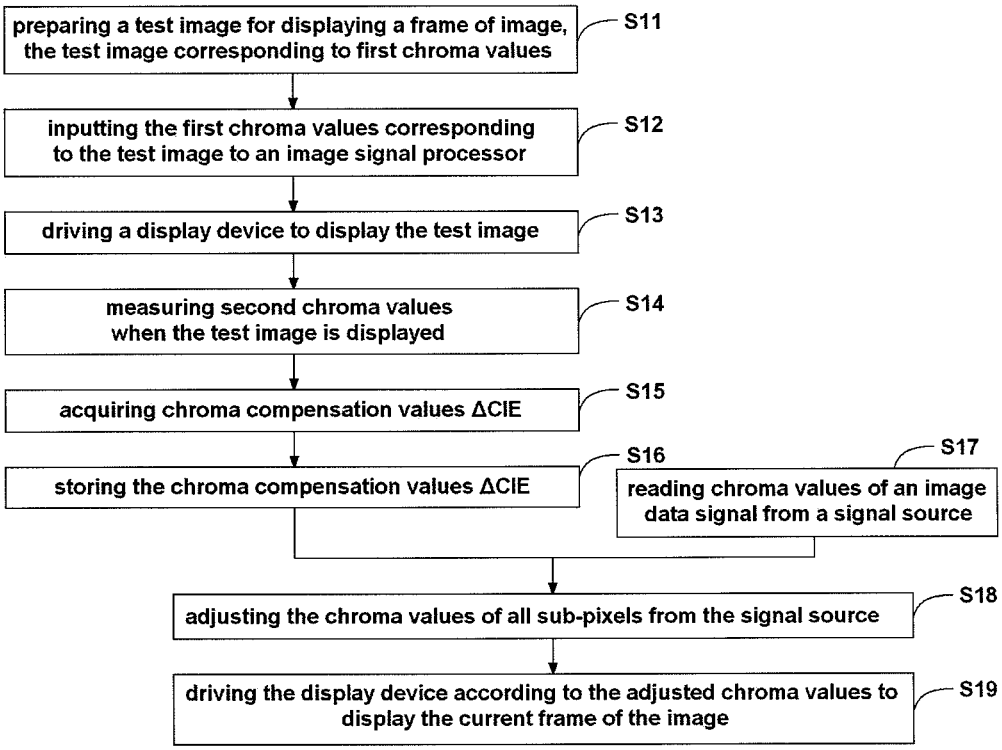
FIG. 2 is a schematic diagram of a specific flow of the image display control method provided by the embodiment of the present invention.

The above-mentioned method of acquiring the chroma compensation values corresponding to respective sub-pixels will be described in detail below with reference to FIG. 2, which may include the following steps.

S11, preparing a test image capable of displaying a frame of an image. Preferably, the chroma values corresponding to respective sub-pixels in the test image are equal to each other, and the chroma values are first chroma values, that is to say, the first chroma values corresponding to respective sub-pixels are equal to each other.

S12, inputting an image data signal corresponding to the test image to an image signal processor.

S13, receiving, by the image signal processor, the image data signal, and driving a display device to display the test image according to the first chroma values corresponding to respective sub-pixels.

It should be noted that, the display device for displaying the test image is the same as the display device for displaying the image output by the signal source.

S14, measuring, at a light exiting side of the display device, second chroma values corresponding to all the sub-pixels when the test image is displayed.

For example, the chroma values of light at a plurality of test angles may be respectively measured at an optimal viewing distance from the light exiting side of the display device by adopting a chroma measurement device such as a chroma measurer, and a plurality of measured chroma values are averaged to obtain the second chroma values respectively corresponding to respective sub-pixels.

S15, subtracting second chroma value from the first chroma value with respect to each of the sub-pixels to obtain a difference between the first chroma value and the second chroma value with respect to each of the sub-pixels, and the differences are the chroma compensation values corresponding to respective sub-pixels.

Specifically, it is supposed that, with respect to a certain sub-pixel, the first chroma value is CIE1 and the second chroma value is CIE2, then the chroma compensation value corresponding to the sub-pixel is $\Delta CIE = CIE1 - CIE2$.

$\Delta CIE$ may be a positive value or a negative value. In a case where the $\Delta CIE$ is a positive value, it indicates that the second chroma value (practically measured value) corresponding to the sub-pixel is small. In this case, after the $\Delta CIE$ is added to the first chroma value corresponding to the sub-pixel, the first chroma value corresponding to the sub-pixel is increased by the $\Delta CIE$, and an appropriate adjusted chroma value is obtained. In a case where the $\Delta CIE$ is a negative value, it indicates that the second chroma value corresponding to the sub-pixel is large. In this case, after the $\Delta CIE$ is added to the first chroma value corresponding to the sub-pixel, the first chroma value corresponding to the sub-pixel is reduced by $|\Delta CIE|$, and an appropriate adjusted chroma value is obtained.

S16, storing the chroma compensation values corresponding to respective sub-pixels. For example, the chroma compensation values are stored in a storage unit of the image signal processor or stored in a memory outside the image signal processor. The storing operation may be executed manually or automatically. It should be noted that, the operation of storing manually may be specifically as follows: the chroma compensation values corresponding to respective sub-pixels are stored in the image signal processor through an input device (e.g. a mouse or a keyboard or the like). The operation of storing automatically may be specifically as follows: a chroma measurement device is connected with the image signal processor, and the chroma measurement device automatically stores the chroma compensation values corresponding to respective sub-pixels into the image signal processor.

It should be noted that, when images are displayed by using the same display device, the chroma compensation values need to be acquired only once within a certain period of time and stored in the storage unit of the image signal processor. The storage unit may be a read-only storage unit.

When each frame of the image is displayed by using the display device, the chroma values corresponding to respective sub-pixels in each frame of the image displayed by the display device are adjusted by adopting the chroma compensation values corresponding to respective sub-pixels.

A specific example of the image display control method according to the present invention will be described in detail below. In the specific example, in addition to the above steps S11 to S16, the method further includes the following steps.

S17, acquiring chroma values, output by a signal source, of all sub-pixels needed when a display device displays the current frame of an image.

An image signal processor may receive an image data signal for driving the display device to display the current frame of an image, and extract the chroma values of all the sub-pixels from the image data signal. The signal source may be any device or system capable of providing the image data signal. The image data signal at least includes information such as brightness and chroma corresponding to respective sub-pixels when the current frame of the image is displayed.

S18, adjusting the acquired chroma values of all the pixels respectively according to the pre-stored chroma compensation values corresponding to respective sub-pixels, so as to obtain adjusted chroma values corresponding to respective sub-pixels. Specifically, the acquired chroma values of respective sub-pixels may be respectively summated with the pre-stored chroma compensation values corresponding to respective sub-pixels through the image signal processor, and the summated values calculated for the sub-pixels are used as the adjusted chroma values corresponding to respective sub-pixels.

S19, driving the display device according to the adjusted chroma values corresponding to respective sub-pixels to display the current frame of the image. It could be understood that, in the practical display process, driving the display device to display the image is not only according to the chroma values corresponding to respective sub-pixels but also at least according to brightness values corresponding to respective sub-pixels.

The beneficial effects brought by the image control method provided by the embodiments of the present invention will be specifically described below.

In the present invention, the practical chroma values (corresponding to the second chroma values of the sub-pixels) of light emitted when the display device displays the image are measured, the second chroma values of the sub-pixels are compared with the chroma values (namely the chroma values, output by the signal source and used for driving the display device to display the image, of all the sub-pixels, corresponding to the first chroma values of the sub-pixels) input before the display device is driven to display the image, so as to obtain the differences between the first chroma values and the second chroma values of the sub-pixels, and the differences are the chroma compensation values corresponding to respective sub-pixels. The obtained differences are pre-stored in the memory of the image signal processor. The image signal processor adjusts the chroma values of all the sub-pixels in the image data signal output by the signal source and used for driving the display device to display the image according to the pre-stored differences, and drives the display device to display the image according to the adjusted chroma values. In such a manner, the adjusted image data signal adapts to the performance or characteristics of hardware adopted by the display device, and an expected display result of chroma is finally obtained. That is, on the premise that the conditions of the hardware adopted by the display device are definite, the deviation of chroma of light caused by the hardware (e.g. a light source or a light filter and the like) adopted by the display device is compensated by adjusting the image data signal output by the signal source. The beneficial effects specifically include the following several aspects.

1. In the present invention, image display is realized by adjusting the image data signal output by the signal source and used for driving the display device, so that the adjusted image data signal adapts to the performance or characteristics of hardware adopted by the display device, the final color display precision of the display device is greatly improved, and the color performance of the display device is improved.

2. In the present invention, image display is realized by adjusting the image data signal output by the signal source and used for driving the display device, so that the quality requirement for the chroma of the hardware of the display device is greatly loosened, and the quality related cost of the display device can be further reduced.

This is because the requirement for the color display effect of the display device limits the chroma range of the display device to be narrow. Moreover, the higher the requirement for the color display effect of the display device is, the smaller the allowed range of chroma errors caused by the hardware adopted by the display device is, and the higher the requirement for the control precision in the industry of display devices and accessories thereof is. Thus, the range of available materials for the light source or the light filter during manufacturing of the display device is small, and the manufacturing cost of the display device is relatively high. The present invention may realize a good color display effect on the display device with a large chroma error range. Because the display device with the large chroma error range is low in manufacturing difficulty and manufacturing cost, the present invention may achieve the satisfied color display effect while reduce the production cost. For example, the image display control method provided by the embodiment of the present invention may greatly widen the applicable range of chroma of a light source (e.g. an LED light source), so as to reduce the cost of the light source.

3. In the present invention, image display is realized by adjusting the image data signal output by the signal source and used for driving the display device, so that the applicable range of chroma of the LED light source is widened, while the existing LED lamp mixed BIN manner may be avoided, and thus the problem of low image quality caused by adopting the LED lamp mixed BIN manner at present is solved.

4. In the present invention, image display is realized by adjusting the image data signal output by the signal source and used for driving the display device, so that when the chroma displayed by the display device is changed due to the factors such as loss or service life, the chroma compensation values may be timely adjusted, namely appropriate chroma compensation values are newly acquired, then the usage result of the display device is improved and the service life of the display device is prolonged.

5. In the present invention, image display is realized by adjusting the image data signal output by the signal source and used for driving the display device, so that the requirement for the hardware adopted by the display device is loosened, then the purpose of universally using a light source (e.g. an LED light source) and a backlight module including the light source in the industry may be achieved, and the cost of the display device is further reduced.

The above-mentioned display device of the present invention may be integrated with a set-top box to become a set-top box capable of adjusting the chroma of an image displayed by the display device, and the set-top box may encompass a common set-top box, a network set-top box and the like.

Of course, the chroma measurement device may be arranged at the optimal viewing distance from the light exiting side of the display device to measure the chroma, or arranged in the display device. During image display, the chroma measurement device and the image signal processor are started sequentially to compensate the chroma and control the image display.

An image display control device provided by an embodiment of the present invention will be specifically described below.

Figure 3:
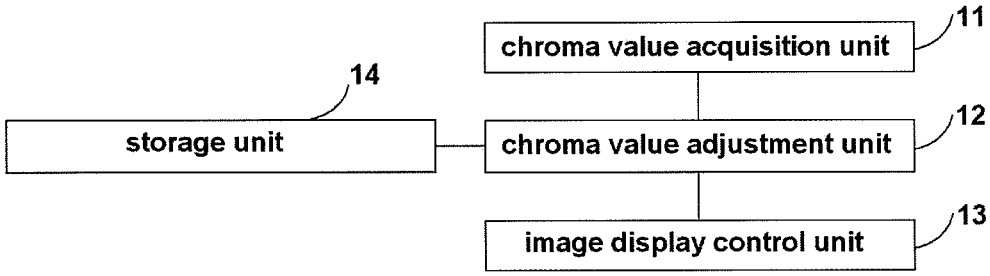
FIG. 3 is a schematic diagram of a structure of an image display control device provided by an embodiment of the present invention.

Referring to FIG. 3, the image display control device includes:

a chroma value acquisition unit 11, configured to acquire chroma values, output by a signal source, of all sub-pixels needed when a display device displays the current frame of an image;

a chroma value adjustment unit 12, configured to respectively adjust the acquired chroma values of respective sub-pixels according to pre-stored chroma compensation values corresponding to respective sub-pixels to obtain adjusted chroma values corresponding to respective sub-pixels; and an image display control unit 13, configured to drive the display device according to the adjusted chroma values to display the current frame of the image.

Preferably, the chroma value adjustment unit 12 is specifically configured to respectively summate the acquired chroma values of respective sub-pixels and the pre-stored chroma compensation values corresponding to respective sub-pixels to obtain the adjusted chroma values corresponding to respective sub-pixels.

Preferably, the image display control device shown in FIG. 3 further includes:

a storage unit 14, configured to pre-store the chroma compensation values corresponding to respective sub-pixels.

Preferably, the image display control device is an image signal processor, e.g. a video/image signal processor matched with the display device.

Figure 4:
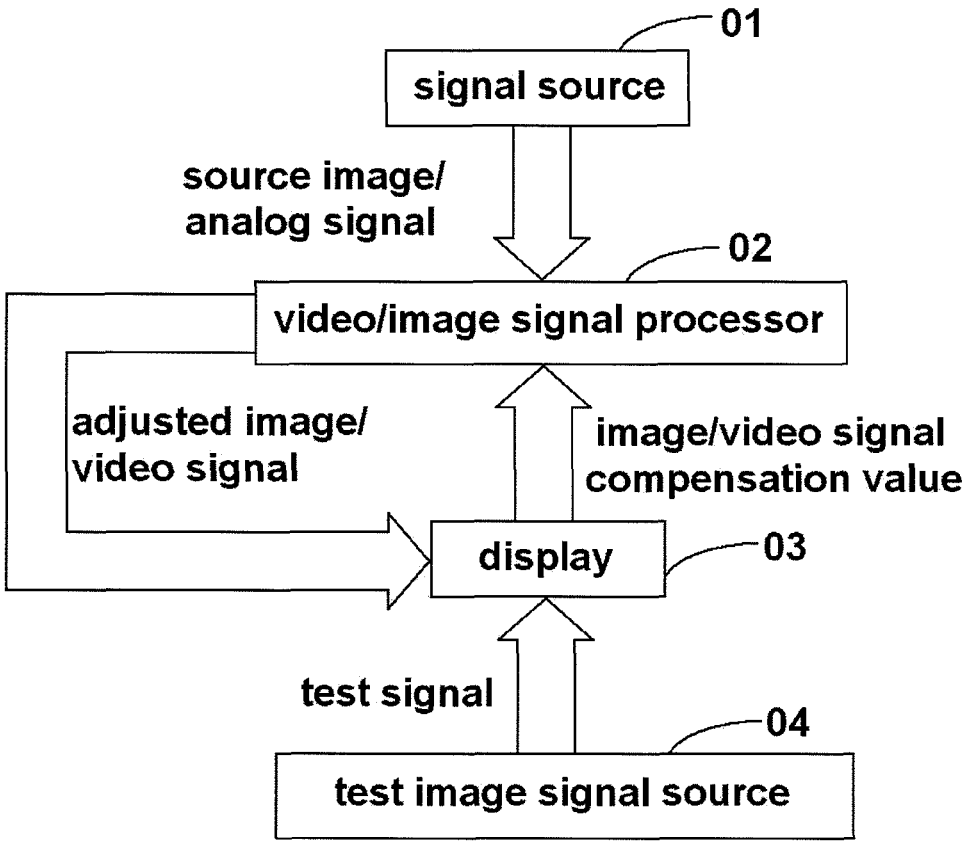
FIG. 4 is an overall frame diagram of image display control provided by an embodiment of the present invention.

Referring to FIG. 4, it is a diagram of a relation among a video/image signal processor 02, a display 03, a signal source 01 and the like in the present invention.

The video/image signal processor 02 acquires a source image/analog signal from the signal source 01;

the display 03 acquires an image/video signal compensation value according to a test signal provided by a test image signal provider 04, and provides the image/video signal compensation value to the video/image signal processor 02.

The video/image signal processor 02 processes the source image/analog signal acquired from the signal source 01 according to the image/video signal compensation value acquired from the display 03 to obtain an adjusted image/video signal, and provides the adjusted image/video signal to the display 03 to drive the display 03 to display an image.

It could be understood that, the image display control device of the present invention may acquire the beneficial effects described for the above image display control device of the present invention.

To sum up, the present invention provides an image display control method and an image display control device, wherein an image data signal may adapt to the performance of hardware adopted in the display device by adjusting the chroma values of each frame of image data before each frame of the image is displayed, so that the image display precision of the display device is improved, the display quality of the display device is improved, and the cost of the display device is reduced.

Obviously, various modifications and variations could be made to the present invention by those skilled in the art without departing from the spirit and scope of the present invention. Thus, provided that these modifications and variations made to the present invention are within the scope of the claims of the present invention and equivalent technologies thereof, the present invention is intended to cover these modifications and variations.

The invention claimed is:

1. An image display control method, comprising the following steps:

acquiring chroma values, output by a signal source, of all sub-pixels needed when a display device displays a current frame of an image;

adjusting the acquired chroma values of all the sub-pixels according to pre-stored chroma compensation values corresponding to respective sub-pixels to obtain adjusted chroma values corresponding to respective sub-pixels;

driving the display device according to the adjusted chroma values corresponding to respective sub-pixels to display the current frame of the image;

wherein before driving the display device to display the current frame of the image, the method further comprises a step of acquiring the chroma compensation values corresponding to respective sub-pixels, and this step further comprises:

acquiring first chroma values respectively corresponding to respective sub-pixels needed when the display device displays a current frame of a test image, and driving the display device according to the first chroma values respectively corresponding to respective sub-pixels to display the current frame of the test image.

measuring, at a light exiting side of the display device, second chroma values respectively corresponding to respective sub-pixels when the current frame of the test image is displayed; and acquiring differences between the first chroma values and the second chroma values respectively corresponding to respective sub-pixels as the chroma compensation values corresponding to respective sub-pixels.

2. The method according to claim 1, wherein the first chroma values respectively corresponding to respective sub-pixels needed when the current frame of the test image is displayed are equal to each other.

3. The method of claim 2, wherein the step of measuring, at the light exiting side of the display device, second chroma values respectively corresponding to respective sub-pixels when the current frame of the test image is displayed further comprises:

respectively measuring the chroma values of light at a plurality of test angles at an optimal viewing distance from the light exiting side of the display device, and taking average values of a plurality of measured chroma values for respective sub-pixels as the second chroma values respectively corresponding to respective sub-pixels.

4. The method according to claim 1, wherein after acquiring the chroma compensation values corresponding to respective sub-pixels and before driving the display device to display the current frame of the image, the method further comprises a step of:

storing the chroma compensation values corresponding to respective sub-pixels.

5. The method according to claim 1, wherein the step of adjusting the acquired chroma values of all the sub-pixels according to pre-stored chroma compensation values corresponding to respective sub-pixels to obtain adjusted chroma values corresponding to respective sub-pixels further comprises:

respectively summating the acquired chroma values of respective sub-pixels and the pre-stored chroma compensation values corresponding to respective sub-pixels, and taking the summated values as the adjusted chroma values corresponding to respective sub-pixels.

6. An image display control device, comprising:

a chroma value acquisition unit, configured to acquire chroma values, output by a signal source, of all sub-pixels needed when a display device displays a current frame of an image;

a chroma compensation value acquiring unit, configured to acquire chroma compensation values by acquiring first chroma values respectively corresponding to respective sub-pixels needed when the display device displays a current frame of a test image, and driving the display device according to the first chroma values respectively corresponding to respective sub-pixels to display the current frame of the test image; by measuring, at a light exiting side of the display device, second chroma values respectively corresponding to respective sub-pixels when the current frame of the test image is displayed; and by acquiring differences between the first chroma values and the second chroma values respectively corresponding to respective sub-pixels, as the chroma compensation values corresponding to respective sub-pixels;

a chroma value adjustment unit, configured to respectively adjust the acquired chroma values of all the sub-pixels according to pre-stored chroma compensation values corresponding to respective sub-pixels to obtain adjusted chroma values corresponding to respective sub-pixels; and an image display control unit, configured to drive the display device according to the adjusted chroma values corresponding to respective sub-pixels to display the current frame of the image.

7. The image display control device according to claim 6, wherein the chroma value adjustment unit is further configured to respectively summate the acquired chroma values of respective sub-pixels and the pre-stored chroma compensation values corresponding to respective sub-pixels to obtain the adjusted chroma values corresponding to respective sub-pixels.

8. The image display control device according to claim 6, further comprising a storage unit configured to store the chroma compensation values corresponding to respective sub-pixels.

* * * * *